US008664550B2

(12) United States Patent
Ao et al.

(10) Patent No.: US 8,664,550 B2
(45) Date of Patent: Mar. 4, 2014

(54) MULTI-POLE CIRCUIT BREAKER WITH AUXILIARY SUPPORTING PIECES

(75) Inventors: Denggui Ao, ShangHai (CN); Shangjing Wei, Shanghai (CN)

(73) Assignee: Noark Electrics (Shanghai) Co., Ltd., Shanghai (CN)

( * ) Notice: Subject to any disclaimer, the term of this patent is extended or adjusted under 35 U.S.C. 154(b) by 207 days.

(21) Appl. No.: 13/321,473

(22) PCT Filed: May 19, 2010

(86) PCT No.: PCT/CN2010/000706

§ 371 (c)(1),
(2), (4) Date: Nov. 18, 2011

(87) PCT Pub. No.: WO2010/139185

PCT Pub. Date: Dec. 9, 2010

(65) Prior Publication Data

US 2012/0061215 A1 Mar. 15, 2012

(30) Foreign Application Priority Data

Jun. 5, 2009 (CN) ..... 2009 1 01435851

(51) Int. Cl.
*H01H 1/20* (2006.01)

(52) U.S. Cl.
USPC ..... 200/17 R; 200/50.32; 218/7; 218/153

(58) Field of Classification Search
USPC ..... 200/244, 400, 401, 335, 43.14, 17 R, 200/50.02–50.05; 335/201, 202, 6, 8–10; 218/7, 14, 152–155
See application file for complete search history.

(56) References Cited

U.S. PATENT DOCUMENTS

| | | | | |
|---|---|---|---|---|
| 5,300,907 | A * | 4/1994 | Nereau et al. | 335/172 |
| 6,211,757 | B1 * | 4/2001 | Castonguay et al. | 335/6 |
| 6,259,338 | B1 * | 7/2001 | Boeder et al. | 335/6 |
| 6,960,731 | B2 * | 11/2005 | Azzola et al. | 200/244 |
| 7,541,899 | B2 * | 6/2009 | Ahn | 335/8 |
| 8,207,459 | B2 * | 6/2012 | Bae | 200/50.32 |

* cited by examiner

*Primary Examiner* — Renee Luebke
*Assistant Examiner* — Ahmed Saeed
(74) *Attorney, Agent, or Firm* — Merek, Blackmon & Voorhees, LLC

(57) ABSTRACT

The present invention discloses a multi-pole circuit breaker with auxiliary supports, which comprises a base, a plurality of single-pole circuit breaking units, an operating mechanism and a rotation axis assembly, wherein the rotation axis assembly consists of a plurality of supporting assemblies and a plurality of support shaft parts in series; each of the support shaft parts is provided with a movable contact bridge; each of the supporting assembly consists of a rotation axis, an auxiliary support, an auxiliary support bearing and at least one supporting rod; the rotation axis maintains synchronous revolution with the support shaft parts; the outside of the bearing is tightly assembled with a bearing hole of the auxiliary support, while the inside is tightly assembled with the rotation axis; the supporting rod is tightly assembled with a supporting rod installing hole on the auxiliary support; the operating mechanism is fixedly connected with the supporting rod; and the supporting rod is fixedly installed on a housing of the single-pole circuit breaking unit and provides stable supporting force for the rotation axis through the auxiliary supports. The multi-pole circuit breaker has balanced contact pressure at each contact point, flexible operation, fast breaking, good breaking synchronism of contacts at all poles and long service life.

7 Claims, 4 Drawing Sheets

MULTI-POLE CIRCUIT BREAKER WITH AUXILIARY SUPPORTING PIECES

TECHNICAL FIELD

The present invention relates to a low voltage circuit breaker, in particularly to an auxiliary support structure suitable for rotation axis assembly of a double-breakpoint multi-pole circuit breaker.

BACKGROUND ART

The low voltage circuit breaker is a low voltage electric appliance having protective function and performing on/off between an input end and a load end of a main circuit, and at least comprises a contact system performing on/off of the main circuit, an operating mechanism controlling the contact system to perform on/off, a terminal strip for connecting the circuit breaker with the input end and the load end of the main circuit and a housing for installing the operating mechanism, the contact system and the terminal strip; the contact system further comprises a movable contact, a stationary contact and a support shaft parts, the movable contact is installed on the support shaft parts and performs closing/opening with the stationary contact along with the movement of the support shaft parts. The support shaft parts is connected with the operating mechanism and moves along with the control of the operating mechanism. There are two types of contact system, i.e. the double-breakpoint contact system and the single-breakpoint contact system. Each pole of the double-breakpoint contact system has two movable contact points, which are connected in series, and two stationary contact points, which are connected to the input end and the load end of the main circuit respectively, while each pole of the single-breakpoint contact system only has one movable contact point and one stationary contact point. The contact system of the single-pole circuit breaking unit only has a group of the movable contacts and the stationary contacts, while the multi-pole circuit breaker has a plurality of groups of the movable contacts and the stationary contacts, and the number of the groups of the stationary contacts is equal to that of the poles of the circuit breaker.

The double-breakpoint contact system has higher breaking ability than the single-breakpoint contact system, the current is broken at two serial contacts of the circuit breaker, each contact bears low mechanical and thermal stresses and includes two serial arc voltages so as to enhance the breaking ability, therefore, the double-breakpoint contact system is widely applied to moulded case circuit breaker. But for the single-pole circuit breaking units of the double-breakpoint contact system, the following problem needs to be addressed: how to realize balanced mechanical contact pressure between two pairs of the movable contacts and the stationary contacts, otherwise, the electric conductivity of the circuit breaker will be reduced. The Euro Patent EP0314540 discloses a single-pole circuit breaking unit, which is characterized in that: a support shaft parts is a rotation axis; a movable contact having two contact points is installed on the rotation axis; a central point between the two contact points overlaps the center of the rotation axis in order to maintain the moving tracks of the two movable contact points symmetrical; the contact pressure between the two movable contact points and stationary contact points is provided by the spring in order to address the problem that the contact pressure of two groups of contacts of the single-pole circuit breaking unit is distributed unevenly. The Patent EP0314540 has the defects that: the revolving precision of the rotation axis is quite inferior; and the problem that the rotation axis system is stable and suitable in the multi-pole circuit breaker system is not taken into consideration.

The rotation axis in the multi-pole contact system is long in extension, obvious twist is formed as the rotation axis is stressed during revolution so that the movement of the movable contact far away from the center circuit breaker is quite late, which dramatically aggravates the problem of unbalanced contact pressure of the contacts at all poles. Furthermore, the contact system at each pole of the multi-pole circuit breaker needs to be installed and isolated in an independent extinguishing chamber as required by arc extinguishing, so a plurality of groups of the movable contacts cannot be installed in respective extinguishing chamber before the rotation axis equipped with a plurality of groups of the movable contacts penetrates through partitioning walls of the extinguishing chambers, accordingly, it is quite apparent that this brings great difficulty to the design of the supporting structure of the rotation axis, and further, the technical difficulties including complex supporting structure of the rotation axis, difficult installation and debugging and the like are caused.

The invention patent with the application number CN200710151603.1 provides a technical proposal different from the present invention, which is characterized in that: a rotation axis assembly consists of a plurality of support shaft parts, a rotation axis and a rolling bearing and is installed through the rolling bearing thereon as well as a bearing pedestal and a bearing cover plate on a partitioning wall inside a housing of the multi-pole circuit breaker. This proposal can raise the moving precision and flexibility of the rotation axis assembly greatly, however, there are two limitations: 1, according to this proposal, the rotation axis is stabilized only by means of the partitioning wall, so the rotation axis assembly cannot be installed and supported on the partitioning wall of the circuit breaker stably without the cooperation of the bearing cover plate, in this way, the installation precision is unsatisfactory, the debugging is complex and the production efficiency is impacted; and 2, in order to guarantee the supporting stability and precision, this technical proposal fails to be applicable to the multi-pole circuit breaker consisting of a plurality of independent splitting single-pole circuit breaking units, but only to the multi-pole circuit breaker with an integrally structured housing, namely the single-pole circuit breaking units divided by the portioning walls.

The multi-pole circuit breaker consisting of independent splitting single-pole circuit breaker units is advantageous for the optimization of industrial production efficiency and the reduction of production cost, and the circuit breakers with different number of poles can be manufactured only by adopting one production line, one set of moulds and one part since every single-pole circuit breaker unit is universal for the circuit breakers with different number of poles. However, the independent splitting single-pole circuit breaking units need to be controlled by the same operating mechanism in order to perform on/off and tripping operations, hence, new difficult problem is brought to the design of the supporting and drive structures of the rotation axis.

SUMMARY OF THE INVENTION

The present invention is related to a circuit breaker with auxiliary supports, which is designed for the purpose of overcoming a series of defects of the multi-pole circuit breakers in the prior art that unreasonable support of the rotation axis leads to obvious twist of the rotation axis to further result in unbalanced contact pressure of movable contact points and stationary contact points and that unreasonable design of the rotation axis assembly results in large operation drive force and tripping drive force, inflexible revolution of the rotation axis, slow tripping, large manufacturing difficulty, high production cost, etc. According to the technical proposal of the present invention, an operating mechanism is supported on a supporting rod of a rotation axis system, and the supporting rod and an auxiliary supporting rod are used for directly providing stable multipoint supporting forces for the rotation axis, thus the moving stability of support shaft parts is ensured, the equilibrium of the contact pressure at the contacts is reinforced, the structure is simplified, intrinsic performances of products are greatly enhanced, such as breaking ability, reliability, safety, etc., and the service life of products is prolonged. In order to achieve the above objectives, the following technical proposal is adopted:

A multi-pole circuit breaker with auxiliary supports comprises a base, N single-pole circuit breaking units, an operating mechanism controlling the single-pole circuit breaking units to perform breaking operations and a rotation axis assembly for all the single-pole circuit breaking units. The single-pole circuit breaking unit comprises: a housing, an extinguishing chamber, two stationary contacts distributed symmetrically, two arc extinguishing grids distributed symmetrically and two terminal strips connected with the stationary contacts respectively, The rotation axis assembly consists of N−1 supporting assemblies and N support shaft parts in series, two sides of each supporting assembly are both provided with a support shaft parts (12), each support shaft parts is provided with a bridge-type double breakpoint movable contact, and the movable contact is in supporting connection with the contact through a spring thereon. The operating mechanism is directly connected with the rotation axis assembly in order to directly drive N movable contacts on the support shaft parts and the stationary contacts of the single-pole circuit breaking unit units to perform synchronous opening/closing operation.

The supporting assembly consists of a rotation axis, an auxiliary support, an auxiliary support bearing and at least one supporting rod; a shaft hole is arranged at a shaft center of the support shaft parts, the rotation axis is inserted into the support shaft parts at two sides of the support assembly through the shaft holes, and the rotation axis maintains synchronous revolution with the support shaft parts. A bearing hole is arranged on the auxiliary support, an outer side of the bearing is tightly assembled with the bearing hole on the auxiliary support, an inner side of the bearing is tightly assembled with the rotation axis, the tight assembling means a stable connection relation, and when the circuit breaker is in the process of moving, the tight assembling prevents dislocation or relative displacement between the outer side of the bearing and the auxiliary support as well as between the inner side of the bearing and the rotation axis.

The bearing in the technical proposal of the invention may be a rolling bearing or a sliding bearing. When the bearing is the rolling bearing, the rotation axis and an inner ring of the rolling bearing are installed in a manner of interference fit, an outer ring of the rolling bearing and the bearing hole on the auxiliary support are installed in a manner of interference fit, and between the outer ring and the inner ring of the bearing, a roller is guided and driven by a retaining rack of the bearing to roll on a correct rollway. When the bearing is the sliding bearing, a bush of the sliding bearing is formed on the auxiliary support; and the journal is formed on the rotation axis. In this way, it is ensured that the auxiliary supports can provide stable supporting force for the rotation axis.

At least one supporting rod installing hole is arranged on the auxiliary support, the supporting rod is tightly assembled with the supporting rod installing hole, the supporting rod is arranged in parallel to the rotation axis, and the supporting rod is used for all the supporting assemblies. The operating mechanism is also fixedly connected with a rotation axis assembly through the supporting rod; the supporting rod is fixedly installed on a housing of the single-pole circuit breaking unit and provides stable supporting force for the rotation axis through the auxiliary supports. Such a support system has the advantage that: while providing supporting force for the operation system, the supporting rod also directly provides supporting force for the rotation axis through the auxiliary supports with the supporting force of the housing being transferred, and it is proved by experiments that this new support system can remarkably eliminate the twist phenomenon of the contacts at far end.

In order to further stabilize the connection relation between the rotation axis and the support shaft parts, the following technical proposal is also adopted: the rotation axis is provided with at least one outer plane at the position adjacent to the support shaft parts, at least one inner plane is arranged inside the shaft hole of the support shaft parts, the outer plane is tightly adhered to the inner plane to operate in a manner of corresponding and matching one-by-one, in order to prevent dislocation between the rotation axis and the shaft hole caused by moment load.

The operating mechanism installed on the rotation axis assembly drives the support shaft parts to move by controlling a connecting rod. The support shaft parts is provided with an operating mechanism control hole, a control operation arm is stretched out of the operating mechanism, and the control operation arm is directly connected into the operating mechanism control hole of the support shaft parts in order to complete the direct drive and control of the operating mechanism to the support shaft parts.

When a plurality of supporting rods is used, an angle $\alpha$, with the rotation axis as a center of circle, between two adjacent supporting rods is from 60 to 120 degrees.

The design of the present invention can be flexibly suitable for circuit breakers with a plurality of types of housings, the housing of the single-pole circuit breaking units and the base of the multi-pole circuit breaker can be one integrally formed element; or the housings of the single-pole circuit breaking units and the base of the multi-pole circuit breaker respectively are independent elements formed in a splitting manner; or the housing of the single-pole circuit breaking units are one integrally-formed element, which is formed in a splitting manner with respect to the base of the multi-pole circuit breaker. These technical proposals are applicable to the design proposal of the present invention.

DETAILED DESCRIPTION OF THE INVENTION

Detailed description is made below to the embodiments of the multi-pole circuit breaker with auxiliary supports according to the present invention with reference to the drawings, and the multi-pole circuit breaker with auxiliary supports according to the present invention is not limited to the following detailed description.

Figure 1:
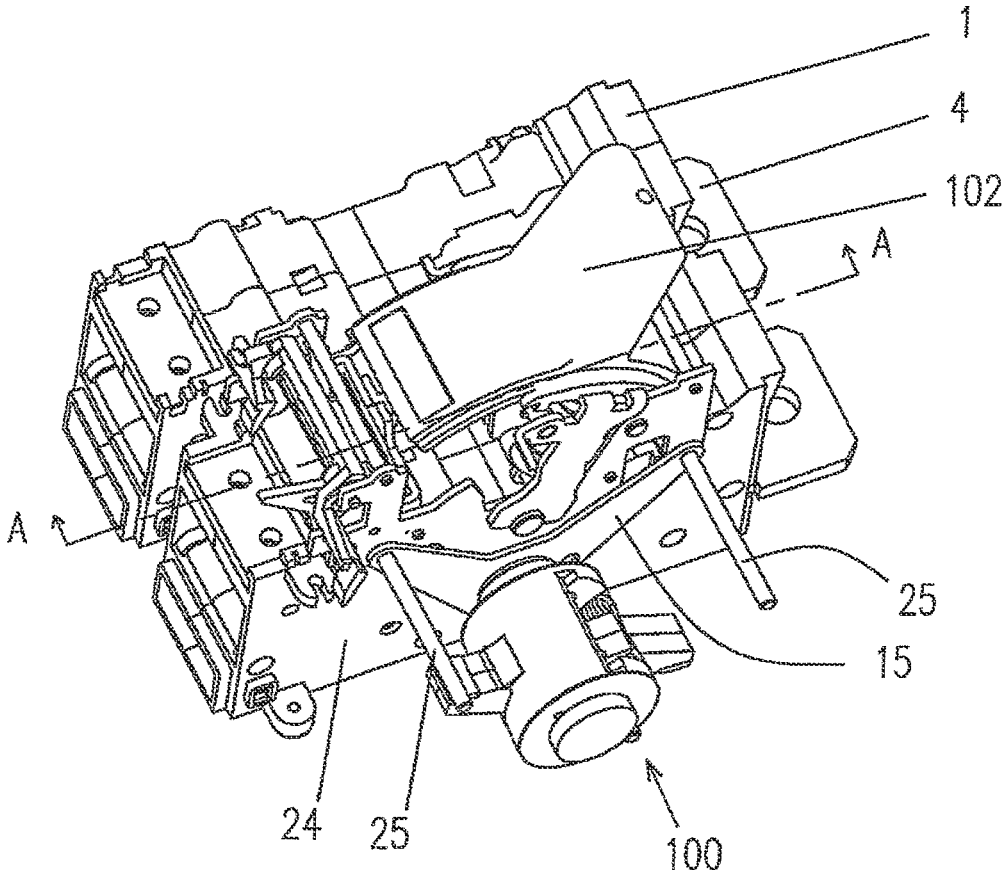
FIG. 1 is a partial structural perspective view of one specific embodiment of the 3-pole circuit breaker with auxiliary supports according to the present invention.

The pole number N of the circuit breaker can be determined, as required by production, as 2, 3 or 4 poles, etc., FIG. 1 shows a partial structural perspective view of the 3-pole circuit breaker with the structure of the third pole being partially shown only. The multi-pole circuit breaker comprises: a plurality of single-pole circuit breaking units 1, the number of which is equal to the pole number N of the circuit breaker (N is 3 as shown in FIG. 1); a base (not shown in the Figure), on which a plurality of the single-pole circuit breaking units 1 are all installed; an operating mechanism 102, which is used for controlling the N single-pole circuit breaking units to perform opening/closing operations; and N single-pole circuit breaking units share one rotation axis assembly 100.

Figure 2:
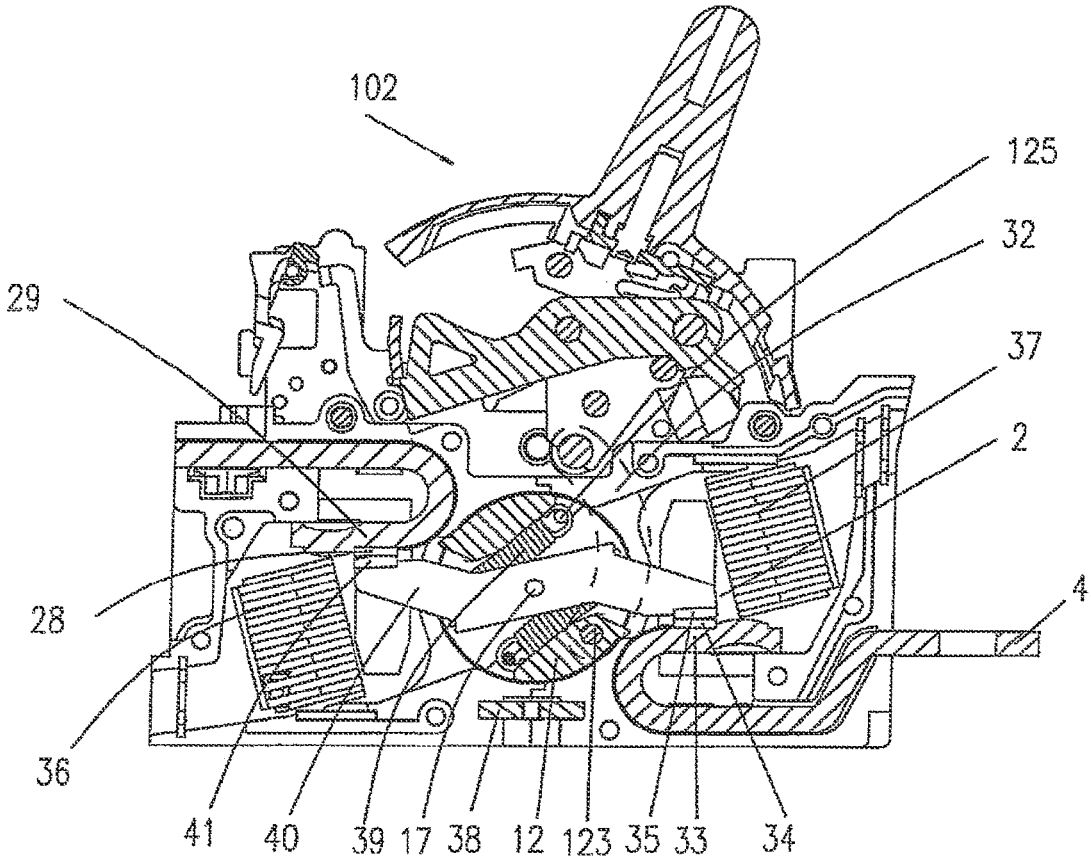
FIG. 2 is an A-A sectional view of the single-pole circuit breaking unit shown as FIG. 1.

Shown as FIGS. 1 and 2, each single-pole circuit breaker unit 1 comprises the following elements: an extinguishing chamber 2 formed by a housing 24 of the single-pole circuit breaker unit; two stationary contacts distributed symmetrically with respect to the shaft center of the rotation axis, i.e. a first stationary contact 29 and a second stationary contact 33 shown as FIG. 2; two arc extinguishing grids distributed symmetrically with respect to the shaft center of the rotation axis, i.e. a first arc extinguishing grid 36 and a second arc extinguishing grid 37 shown as FIG. 2; and two terminal strips connected with the two stationary contacts respectively, wherein one of the terminal strip is a terminal strip 4 shown in the Figure and the other one is not shown in the Figure. The first stationary contact 29 is provided with a first stationary contact point 28 and the second stationary contact 33 is provided with a second stationary contact point 34. In the embodiment shown as FIG. 2, the housings 24 of the single-pole circuit breaker units 1 are independent elements formed in a splitting manner, namely when the housings 24 of a plurality of independent splitting single-pole circuit breaker units are assembled on an independent base, it is required to connect the housings 24 of the single-pole circuit breaker units in series via a connecting plate 38 to form a housing assembly and to fixedly connect the housing assembly with the base of the multi-pole circuit breaker. The connecting plate 38 is arranged on the housing 24 of the single-pole circuit breaking unit and is provided with a thread groove, and through the thread groove, the housing 24 can be fixed on the base by screws. The present invention also can be suitable for a plurality of single-pole circuit breaker units with integrally formed housings, for example: the housing 24 of the single-pole circuit breaking unit is integrally formed with the base of the multi-pole circuit breaker; in this case, the extinguishing chamber of the single-pole circuit breaking unit consists of partitioning walls inside the housing of the multi-pole circuit breaker in fact. No matter which structure is adopted for the housing, the technical proposal of the present invention in which the auxiliary supports are used greatly settles the technical problem that the rotation axis assembly is suitable for both the multi-pole circuit breaker with the independently splitting housing 24 and the multi-pole circuit breaker with the integrally structured housing 24.

Figure 3:
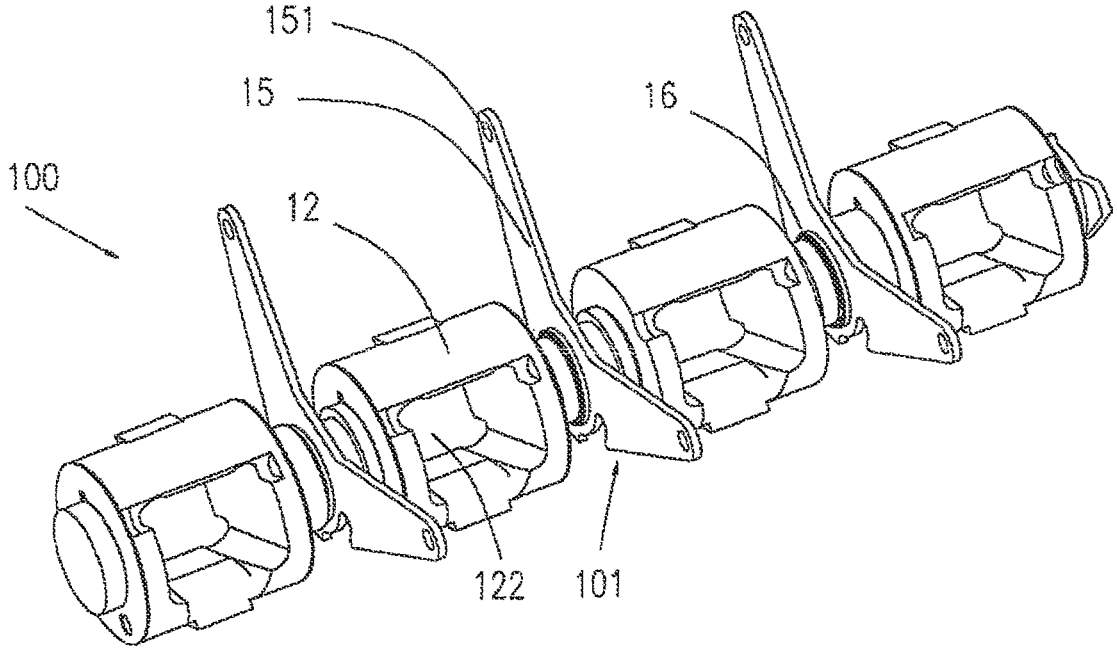
FIG. 3 is a partial schematic diagram of one embodiment of the 4-pole circuit breaker with auxiliary supports according to the present invention, and specifically relates to a structural schematic diagram of the rotation axis assembly.

FIG. 1 and FIG. 3 show the embodiment of a rotation axis assembly 100. Shown as FIG. 3, the rotation axis assembly 100 of a 4-pole circuit breaker consists of N−1 (i.e. 3) supporting assemblys 101 and N (i.e. 4) support shaft parts 12 in series. The supporting assemblies 101 are not only the connectors for the N support shaft parts 12 in series, but provide supporting force for the rotation axis assembly 100 simultaneously. The supporting assembly 101, used for two adjacent support shaft parts, tightly pushes against the ends of the support shaft parts 12 so as to achieve excellent supporting effect. The rotation axis assembly 100 is in the shape of thin and long shaft, however, the supporting structure consisting of a plurality of supporting assemblies 101 enhances the rigidity of the rotation axis assembly 100 remarkably, eliminates the bending deformation thereof and results in quite balanced contact pressure between the movable contact points and the stationary contact points and quite flexible rotation of the rotation axis assembly 100.

Figure 4:
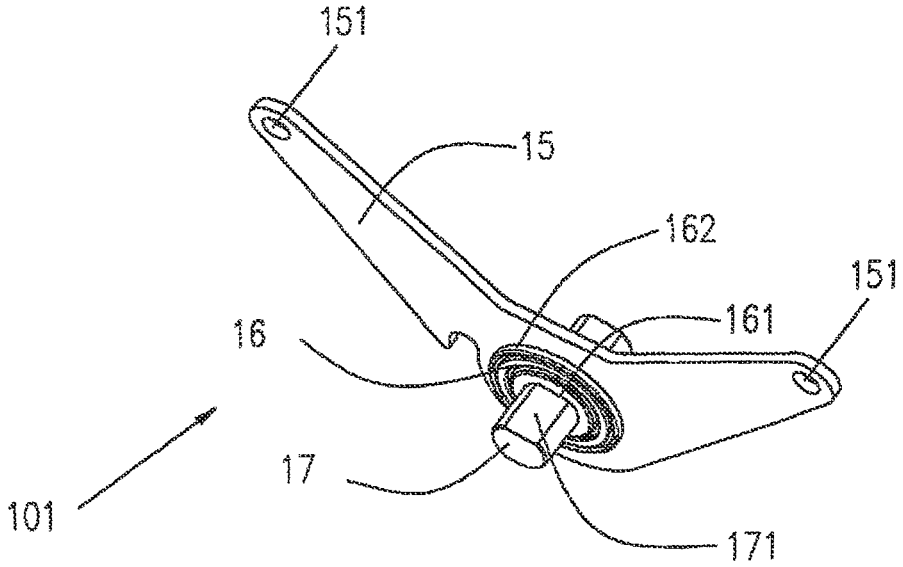
FIG. 4 is a structural schematic diagram of the embodiment of the supporting assembly of the circuit breaker with auxiliary supports according to the present invention.
Figure 5:
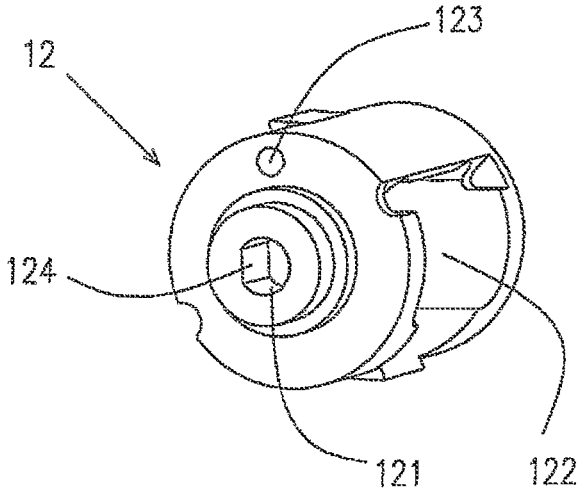
FIG. 5 is a structural schematic diagram of the support shaft parts of the circuit breaker with auxiliary supports according to the present invention.

Shown as FIG. 5, the support shaft parts 12 is provided with a through hole 121, a perforated contact groove 122 vertical to the shaft hole 121, at least one operating mechanism control hole 123 and at least one spring installing part 125; the rotation axis 17 is connected into the support shaft parts 12 at two sides of the support assembly 101 through the shaft holes 121, and the shaft hole 121 is in interference fit with the rotation axis 17 (shown as FIG. 4) in order to guarantee that the rotation axis 17 maintains synchronous revolution with the support shaft parts 12; the contact groove 122 is used for accommodating and installing a movable contact 40 (shown as FIG. 2); the operating mechanism control hole 123 is used for directly connecting the operating mechanism 102 to the support shaft parts 12 so that the support shaft parts 12 can be controlled most directly by the operating mechanism 102; and the spring hole 125 is used for installing a spring 39 (shown as FIG. 2), and the spring 39 is used for installing the movable contact 40 on the support shaft parts 12 and revolving the movable contact 40 along with the revolution of the support shaft parts.

The support shaft parts 12 of the rotation axis assembly 100 are all equipped with the movable contacts 40 (shown as FIG. 2), the movable contacts 40 are fitted with the first stationary contacts 29 (shown as FIG. 2) and the second stationary contacts 33 (shown as FIG. 2) of the single-pole circuit breaker units 1 (shown as FIG. 1) respectively to carry out synchronous closing/opening of the single-pole circuit breaker units, therefore, the rotation axis assembly 100 is the assembly for all the single-pole circuit breaker units. The rotation axis assembly 100 is directly connected with the operating mechanism 102, the operating mechanism 102 is installed on the rotation axis assembly 100 via a supporting rod 25, the controlling connection relation of the operating mechanism 102 to the support shaft parts 12 at all poles is specifically shown as FIGS. 2 and 5, the support shaft parts 12 is provided with the operating mechanism control hole 123, a control operation arm 32 is stretched out of the operating mechanism 102, the control operation arm 32 is directly connected into the operating mechanism control hole 123 of the support shaft parts 12, the control operation arm 32 of the operating mechanism 102 directly drives the support shaft parts 12 to revolve around the shaft center of the rotation axis 17 during the movement of the operating mechanism 102 in order to drive the movable contact 40 installed inside the support shaft parts 12 to synchronously revolve, therefore, under the driving of the operating mechanism 102, the movable contacts on the rotation axis assembly 100 perform synchronous opening/closing operation respectively with the stationary contacts of the single-pole circuit breaker units in order to guarantee the opening/closing synchronism of the movable contact points and the stationary contact points of the multi-pole circuit breaker. It is quite apparent that, the structure of the rotation axis assembly 100 of the present invention is suitable for both the multi-pole circuit breaker with splitting housing and the multi-pole circuit breaker with integrally structured housing.

Shown as FIGS. 1 and 2, the multi-pole circuit breaker with auxiliary supports according to the present invention adopts a movable contact bridge. Two ends of the movable contact 40 are provided with a first movable contact point 41 and a second movable contact point 35. The first movable contact point 41 and the second movable contact point 35 are arranged in a manner of point symmetry around the shaft center of the rotation axis 100. The first movable contact point 41 and the first stationary contact point 28 are fitted with each other to perform closing/opening operation of the circuit breaker, and the second movable contact point 35 and the second stationary contact point 34 are fitted with each other to perform closing/opening operation of the circuit breaker. The first movable contact point 41 and the second movable contact point 35 are arranged in a manner of point symmetry, so the rotation axis assembly 100, when revolving around the shaft center of the rotation axis 17 at an operating angle, drives the first movable contact point 41 and the second movable contact point 35 to perform closing/opening operation in order to perform on/off operation on the main circuits of the single-pole circuit breaker units. The movable contact 40 is installed in the contact groove 122 (shown as FIG. 5) of the support shaft parts 12 through the spring 39, such an elastic installation structure has the advantages that: elastic contact pressure can be formed between the movable contact point and the stationary contact point to improve contact reliability; the contact pressure on the first movable contact point 41 and the contact pressure on the second movable contact point 35 can be balanced; and the impact resulting from over-travel operation of the movable contact on the movable contact and the stationary contact can be mitigated. Both the first stationary contact 29 and the second stationary contact 33 are provided with a U-shaped structure respectively that can make the current directions of the movable contact and the stationary contact near the contact points opposite to each other, in order to automatically generate electromagnetic repulsion between the movable contact and the stationary contact under high current (overload or short-circuit current) to further enhance the breaking ability. In the embodiment shown as FIG. 2, the spring 39 is two tension springs. One end of the spring 39 is connected with the support shaft parts 12 and the other end is connected with the movable contact 40. In other embodiments, there may be one spring 39 because, by using one spring, the movable contact 40 can be installed on the support shaft parts 12 in the same way and elastic contact pressure can still be formed between the movable contact and the stationary contact in the same way. However, if two springs are arranged symmetrically, the balance of the contact pressures on the first movable contact point 41 and on the second movable contact point 35 can be better. Furthermore, the spring 39 can also adopt torsional spring, that is to say, the torsional spring and the tension spring actually are the same alternative embodiments.

Shown as FIGS. 1, 3 and 4, the supporting assembly 101 consists of the rotation axis 17, a bearing 16 of the auxiliary support 15, the auxiliary support 15 and the supporting rod 25. Shown as FIG. 6, the auxiliary support 101 is provided with a bearing hole 153 for the installation of the bearing and further with at least one supporting rod installing hole 151 for the connection with the supporting rod 25. The bearing 16 is installed in the bearing hole 153 of the auxiliary support 101 and can be one of the rolling bearing or the sliding bearing, and the rotation axis 17 is installed inside the bearing 16. The rotation axis 17 is tightly fitted with the auxiliary support 101 through the bearing 16, so the revolution flexibility of the rotation axis 17 can be maintained while the supporting force for the auxiliary support 101 is obtained. Two sides of the rotation axis 17 are respectively provided with a support shaft parts 12.

Shown as FIGS. 4 and 5, shaft tips at two ends of the rotation axis 17 near the support shaft parts 12 are each provided with an outer plane 171 parallel to the revolving axis; the side face of the support shaft parts 12 is provided with a shaft hole 121 for the installation of the rotation axis 17, the shaft hole 121 is internally provided with an inner plane 124 parallel to the center line of the shaft hole 121, the inner plane 124 is fitted with the outer plane on the rotation axis 17 in both quantity and shape, and when the shaft tips of the rotation axis 17 is inserted into the shaft holes 121, the outer plane 171 is tightly adhered to the inner plane 124 to guarantee that the rotation axis 17 and the support shaft parts 12 synchronously revolve around the shaft center of the rotation axis 17. The shaft tip on the rotation axis 17 is in interference fit with the shaft hole 121 of the support shaft parts 12, however, the shaft tip and the shaft hole 121 can be installed smoothly by means of tools. Owing to the interference fit between the shaft tip and the shaft hole 121 and the tight adherence between the outer plane 171 on the shaft tip and the inner plane of the shaft hole 121, no loosening and dislocation between the rotation axis 17 and the support shaft parts 12 is guaranteed, and no matter which load (e.g. impact load, moment load) is applied to the rotation axis 17 and the support shaft parts 12, the hidden troubles of loosening and dislocation are completely avoided. From what is described above, the following conclusions can be drawn by reasoning: at least one outer plane 171 is arranged on the shaft tips at two ends of the rotation axis 17, at least one inner plane 124 is arranged on the support shaft parts 12, the inner plane(s) 124 should be fitted with the outer plane(s) 171 one by one in quantity and positional relation. It is quite apparent that, when the number of the inner plane(s) 124 and the outer plane(s) 171 increases, the manufacturing difficulty will be raised, but the technical effect of preventing dislocation can be improved.

The specific embodiment of the bearing 16 shown as FIGS. 3 and 4 is the rolling bearing 16. The rolling bearing 16 comprises for basic elements, i.e. an inner ring at an inner side 161 of the bearing, an outer ring at an outer side 162 of the bearing, a roller (not shown in the Figure) between the inner ring and the outer ring and a retaining rack (now shown in the Figure). The outer ring 162 of the rolling bearing 16 is installed inside the bearing hole 153 of the auxiliary support 15, and both are tightly installed in a manner of being fitted with each other. In order to prevent loosening between the outer ring and the bearing hole 153, interference fit should be adopted between the outer ring and the bearing hole 153, but smooth assembly by means of tools should be guaranteed. The inner ring 161 of the rolling bearing 16 is installed on the rotation axis 17, and both are tightly installed in a manner of being fitted with each other. In order to prevent loosening between the inner ring and the rotation axis 17, interference fit should be adopted between the inner ring and the rotation axis 17, but smooth assembly by means of tools should be guaranteed. Rolling friction is formed between the outer ring 162 and the inner ring 161 through the roller, such as rolling ball. Due to the adoption of the rolling bearing 16, the rotation axis assembly 100 has very high revolving precision and quite flexible revolution.

Another alternative of the bearing 16 is the sliding bearing. The sliding bearing comprises two basic elements, i.e. a journal at the inner side 161 of the bearing and a bush at the outer side 162 of the bearing. The journal of the sliding bearing is formed on the supported rotation axis 17, and both can be integrally formed or assembled in a splitting manner; the bush of the sliding bearing is formed on the auxiliary support 15 which supports the bearing, and both can integrally formed or assembled in a splitting manner. A technical proposal of the present invention preferable to the proposal in which the sliding bearing is adopted is as below: the bush of the sliding bearing is formed on the auxiliary support 15 and is integrally formed with the bearing hole 153 on the auxiliary support 15; the journal is formed in the middle of the rotation axis 17, and sliding friction between the journal at the inner side 161 of the bearing and the bush at the outer side 162 of the bearing is realized through lubricating agent. Detailed description is made below to the differences of the technical proposal in which the sliding bearing is adopted from the above technical proposal in which the rolling bearing is adopted with reference to FIGS. 4 and 6. Shown as FIG. 6, the auxiliary support 15 is provided with the bearing hole 153; when the rolling bearing is adopted, the rolling bearing 153 is in interference fit with the outer ring of the rolling bearing; when the sliding bearing is adopted, the bearing hole 153 is in direct sliding fit with the rotation axis 17 in order to provide sliding supporting for the rotation axis 17. In the rotation axis 17 shown as FIG. 4, when the sliding bearing is adopted, the journal is in sliding fit with the bearing hole 153 (shown as FIG. 6) of the auxiliary support 15. It can be easily determined from the comparative analysis of the two proposals that: the auxiliary support 15 can support the rotation axis 17 only through the bearing, so the rotation axis 17 needs to be installed with the bearing in a fitting manner and the bearing needs to installed with the auxiliary support 15 in a fitting manner; when the rolling bearing 16 is adopted, the fitting installation relations among the rotation axis 17, the rolling bearing 16 and the auxiliary support 15 are quite understandable; when the sliding bearing is adopted, the fitting installation relations among the rotation axis, the sliding bearing and the auxiliary support 15 are special as two sliding supporting face-mounted elements (the journal arranged on the rotation axis 17 and the bush arranged on the auxiliary support 15) of the sliding bearing are formed on the rotation axis 17 and the auxiliary support 15 respectively. And in this special case: the rotation axis 17 and the journal of the sliding bearing are integrally formed; and the bush of the sliding bearing and the auxiliary support 15 are integrally formed. Another alternative embodiment is that the bush of the sliding bearing and the auxiliary support 15 are two splitting elements, which are tightly assembled on the rotation axis 17 and on the auxiliary support 15 respectively, so it is quite apparent that the structure of this embodiment is more complex than the above integrally formed structure, but the basic technical effects are the same.

Compared with the rolling bearing, the sliding bearing has the advantages of simple structure, low manufacturing cost and the like; however, the revolution flexibility of the sliding bearing is much worse than that of the rolling bearing. It is quite apparent that the supporting assembly 101 of the present invention adopts the rolling bearing preferably, or can adopt the sliding bearing.

Shown as FIGS. 1, 3, 4 and 5, the auxiliary support 15 is provided with at least one supporting rod installing hole 151, the supporting rod installing hole 151 is used for the tight connection with the supporting rod 25 in a fitting manner in order to fixedly install the auxiliary support 15 on the housing 24 of the single-pole circuit breaking unit or the base (not shown) of the multi-pole circuit breaker, and the supporting rod is arranged in parallel to the rotation axis 17. Such a suspending structure guarantees that the circuit breakers of all poles and the rotation axis 17 of the support shaft parts 12 thereof can revolve coaxially and stably. In order to ensure the installation stability of the auxiliary support 15, positioning devices can be arranged on the supporting rod 25 and on two sides of the auxiliary support 15.

Figure 6:
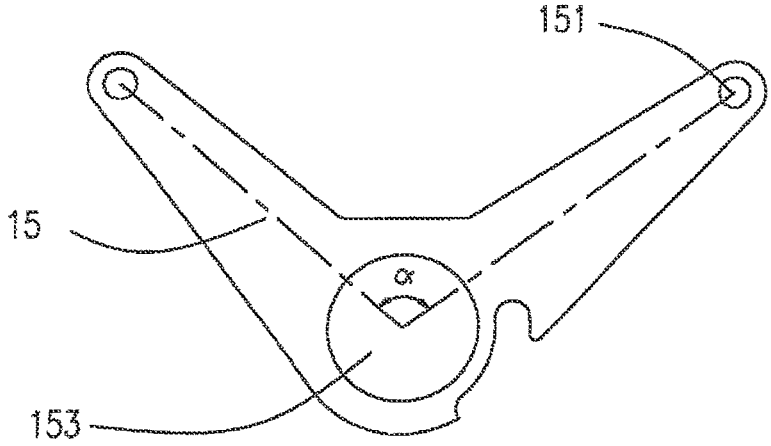
FIG. 6 is a structural schematic diagram of the specific embodiment of the auxiliary support of the circuit breaker with auxiliary supports according to the present invention.

In a preferred embodiment shown as FIG. 1, two supporting rods 25 are adopted; the two supporting rods 25 are respectively arranged at two sides of the rotation axis 17 in parallel to the rotation axis 17, the supporting rods 25 are used for all the single-pole circuit breaking units 1, each auxiliary support 15 on the rotation axis assembly 100 is connected to the two supporting rods 25, and the two supporting rods are fixedly installed on the housing 24 of the single-pole circuit breaking units. It can be easily determined, based on the principals of mechanics, that the embodiment has the advantages that: the auxiliary supports are all connected to the supporting rods 25, so not only the supporting rods 25 provide supporting force for every auxiliary support 15, but the supporting force for the auxiliary supports 15 is also free from mutual interference, so as to guarantee the revolution precision and the revolution flexibility of the rotation axis assembly 100; and by adopting two supporting rods 25 to jointly provide supporting force for the auxiliary supports, the positioning precision of the auxiliary supports 15 can be enhanced remarkably. It is quite apparent that, when only one supporting rod 25 is adopted, the positioning precision of the auxiliary supports 15 is reduced; and when more than two supporting rods 25 are adopted, the installation of the auxiliary supports 15 becomes difficult, and simultaneously, the factor resulting in the interference of the supporting force for the auxiliary supports 15 is also increased. With the rotation axis 17 as a center of circle, a preferred angle $\alpha$ between two adjacent supporting rods with respect to the center of circle is from 60 to 120 degrees (inclusive of endpoints), in order to guarantee the supporting stability, and the angle shown as FIG. 6 is from 90 to 110 degrees.

The invention claimed is:

1. A multi-pole circuit breaker with auxiliary supports, comprising a base, N single-pole circuit breaking units (1), an operating mechanism (102) controlling the single-pole circuit breaking units to perform breaking operations, and a rotation axis assembly (100) for all the single-pole circuit breaking units, the single-pole circuit breaking unit (1) comprising a housing, an extinguishing chamber (2), two stationary contacts (29, 33) distributed symmetrically, two arc extinguishing grids (36, 37) distributed symmetrically, and two terminal strips (4) connected with the stationary contacts respectively, the rotation axis assembly (100) consisting of N−1 supporting assemblies (101) and N support shaft parts (12) in series, two sides of each supporting assembly (101) being both provided with a support shaft parts (12), and each support shaft parts (12) being provided with a movable contact bridge (40), the operating mechanism (102) being directly connected with the rotation axis assembly (100) in order to directly drive N movable contacts (40) on the support shaft parts (12) and the stationary contacts (29, 33) of the single-pole circuit breaking units (1) to perform synchronous opening/closing operation, the multi-pole circuit breaker being characterized in that:

the supporting assembly (101) consists of a rotation axis (17), an auxiliary support (15), an auxiliary support bearing (16) and at least one supporting rod (25);

a shaft hole (121) is arranged on the support shaft parts (12), the rotation axis (17) is inserted into the support shaft parts (12) at two sides of the support assembly (101) through the shaft holes (121), and the rotation axis (17) maintains synchronous revolution with the support shaft parts (12), a bearing hole (153) is arranged on the auxiliary support (15), an outer side (162) of the bearing (16) is tightly assembled with the bearing hole (153) of the auxiliary support (15), and an inner side (161) of the bearing (16) is tightly assembled with the rotation axis (17), at least one supporting rod installing hole (151) is arranged on the auxiliary support (15), the supporting rod (25) is tightly assembled with the supporting rod installing hole (151), the supporting rod (25) is arranged in parallel to the rotation axis (17), and all the supporting assemblies (101) share the supporting rod (25), the operating mechanism (102) is fixedly connected with a rotation axis assembly (100) through the supporting rod (25), the supporting rod (25) is fixedly installed on a housing (24) of the single-pole circuit breaking unit and provides stable supporting force for the rotation axis (17) through the auxiliary supports (15).

2. The multi-pole circuit breaker with auxiliary supports according to claim 1, wherein the rotation axis (17) is provided with at least one outer plane (171) at the position adjacent to the support shaft parts (12), at least one inner plane (124) is arranged inside the shaft hole (121) of the support shaft parts (12), the outer plane (171) of the rotation axis is tightly adhered to the inner plane (124) of the support shaft parts to operate in a manner of corresponding and matching one-by-one, in order to prevent dislocation between the rotation axis (17) and the shaft hole (121) caused by moment load.

3. The multi-pole circuit breaker with auxiliary supports according to claim 1, wherein: with the rotation axis (17) as a center of circle, an angle $\alpha$ between two adjacent supporting rods (25) is from 60 to 120 degrees.

4. The multi-pole circuit breaker with auxiliary supports according to claim 1, wherein a control operation arm (32) is stretched out of the operating mechanism (102), the support shaft parts (12) is provided with an operating mechanism control hole (123), and the control operation arm (32) is directly connected into the operating mechanism control hole (123) of the support shaft parts (12) in order to complete the direct drive and control of the operating mechanism (102) to the support shaft parts (12).

5. The multi-pole circuit breaker with auxiliary supports according to claim 1, wherein the bearing (16) is a rolling bearing, the rotation axis (17) and an inner ring of the rolling bearing (16) are installed in a manner of interference fit, and an outer ring of the rolling bearing (16) and the bearing hole (153) on the auxiliary support (15) are installed in a manner of interference fit.

6. The multi-pole circuit breaker with auxiliary supports according to claim 1, wherein the bearing (16) is a sliding bearing; a bush of the sliding bearing is formed on the auxiliary support; and the journal of the sliding bearing is formed on the rotation axis (17).

7. The multi-pole circuit breaker with auxiliary supports according to claim 1, wherein the housings (24) of the single-pole circuit breaking units and the base of the multi-pole circuit breaker are integrally formed; or the housings of the single-pole circuit breaking units and the base of the multi-pole circuit breaker respectively are independent elements formed in a splitting manner; or the housings (24) of the single-pole circuit breaking units are one integrally-formed element, which is formed in a splitting manner with respect to the base of the multi-pole circuit breaker.

* * * * *